United States Patent [19]

Oishi et al.

[11] Patent Number: 4,816,364

[45] Date of Patent: Mar. 28, 1989

[54] MAGNETIC CARRIER PARTICLES FOR ELECTROPHOTOGRAPHIC DEVELOPER HAVING PLATED LAYER OF IRON OXIDE

[75] Inventors: Masao Oishi, Neyagawa; Takao Saito, Toyonaka; Kouichi Nagata, Neyagawa; Katsukiyo Ishikawa, Kuze; Eio Hisajima, Takatsuki, all of Japan

[73] Assignee: Nippon Paint Co., Ltd., Osaka, Japan

[21] Appl. No.: 92,876

[22] Filed: Sep. 3, 1987

[30] Foreign Application Priority Data

Sep. 3, 1986 [JP] Japan ..... 61-209803
Mar. 26, 1987 [JP] Japan ..... 62-75494

[51] Int. Cl.[4] ..... G03G 9/10

[52] U.S. Cl. ..... 430/108; 427/222; 427/306; 428/402.24; 428/403; 428/407; 428/406; 204/56.1; 106/1.12; 430/106.6; 430/137; 430/111

[58] Field of Search ..... 430/108, 111, 137; 427/222, 306; 428/402.24, 403, 407

[56] References Cited

U.S. PATENT DOCUMENTS 4,265,995 5/1981 Mammino ..... 430/109
4,477,319 10/1984 Abe et al. ..... 204/56

FOREIGN PATENT DOCUMENTS 1901643 9/1969 Fed. Rep. of Germany .
142557 8/1984 Japan .
188548 8/1986 Japan .

*Primary Examiner*—J. David Welsh
*Attorney, Agent, or Firm*—Wenderoth, Lind & Ponack

[57] ABSTRACT

The present invention is intended to provide a carrier to be used as a two-component developer, wherein a nuclide particle surface has a magnetic plated layer composed of an iron oxide. The carrier according to the present invention is to be used in the electrophotographic method, electrostatic recording method, and electrostatic printing method, and also provides an excellent developer which is lightweight and has a long service life.

12 Claims, No Drawings

MAGNETIC CARRIER PARTICLES FOR ELECTROPHOTOGRAPHIC DEVELOPER HAVING PLATED LAYER OF IRON OXIDE

BACKGROUND OF THE INVENTION

The present invention relates to a magnetic carrier for use in a two-component developer that is applicable to the methods of dielectric photography, electrostatic printing and electrophotography. In particular, the present invention relates to a lightweight magnetic carrier for use in a developer having a longer service life and having excellent developing properties.

The conventionally known methods for developing an electrostatic latent image formed on a photosensitive drum include the magnetic brush method, fur brush method, pressure developing method, cascade method and the like. However, because of the quality of images obtained, the magnetic brush method is most widely practiced.

In the magnetic brush method, resin particles known as toner are first charged triboelectrically, i.e., the charge is generated by means of friction exerted between the particles. The toner is then allowed to be carried by a turf which comprises of a carrier (for example, iron or ferrite particles) and which is formed on the surface of a sleeve having a magnet disposed inside thereof, whereby the toner powder is transported to the surface of a photosensitive member. Subsequently, the toner is electrostatically deposited on an electrostatic latent image having a negative charge and formed on the photosensitive member, whereby the image is developed. Accordingly, the developer used for this purpose comprises two components; toner and carrier.

Iron powder or treated iron powder used as a carrier have unstable electrical properties, which contribute to a deterioration in image quality. This deterioration is due to a hard turf which is attributable to a highly saturated magnetization. Additionally, iron powder has a larger specific gravity, which necessitates a larger energy for triboelectrical charging. The heat generated by an increased rotational torque allows the toner to readily adhere to the surface of individual carrier particles. As an improved iron carrier, a ferrite carrier has been proposed. However, a ferrite carrier requires a complicated manufacturing process. Additionally, though it is lighter than iron powder ($\frac{2}{3}$ the weight of iron powder), the ferrite carrier does not necessarily satisfy the requirements for a smaller and more energy-efficient copying machine. Furthermore, such a type of carrier has a wider dispersion in magnetic properties due to a wider variety of particle sizes.

To make the carrier lightweight, methods to form a hollow in individual ferrite particles were disclosed in Japanese Patent Laid-Open Publication Nos. 177160/1982 and 23032/1983. According to these methods, the conditions for spraying, drying and the like should be strictly controlled. A minimum deviation in the conditions results in carrier particles having a wider density distribution. When employed in a developing apparatus, carrier particles having less density and toner particles may be thoroughly rubbed together. In contrast, carrier particles having greater density and toner particles are not satisfactorily rubbed together, which allows the toner to have a larger triboelectrical distributon, and which greatly deteriorates the image quality.

To ensure improved image quality, smaller-sized carrier particles are required. To prepare smaller-sized carrier particles, Japanese Patent Laid-Open Publication No. 66134/1979 disclosed small-sized carrier particles, wherein minute magnetic particles are dispersed in a binder resin. With such a magnetic dispersion type carrier, it is difficult to uniformly distribute the magnetic particles. Consequently, the magnetic particles are irregularly distributed on the surface of the carrier, resulting in uneveness in both magnetic properties and electrical properties. After an extended period operation, the binder resin is selectively worn away, and the surface properties, especially the electrical properties of the carrier, vary, thus resulting in deteriorated developing properties.

Japaness Patent Laid-Open Publication No. 34902/1986 disclosed magnetic particles in which hydroxide and/or oxide of iron are deposited on individual porour polymer particles, onto which a polymer film is further formed. This type of magnetic particle is based on the simple deposition of hydroxide and/or oxide of iron, and consequently, the magnetic substance on the particles may be stripped off. For this reason, it is necessary to form a polymer film after the magnetic substance has been deposited.

Furthermore, Japanese Patent Laid-Open Publication No. 93603/1986 disclosed a method wherein individual magnetic particles are provided on the surface thereof with a magnetic powder by using the thermal behavior of core particles. In this method, though the magnetic powder securely deposits on and in the vicinity of the surface of individual polymer particles, there is little, if any, possibility of mutual bonding among the fine magnetic particles. Consequently, the amount of magnetic powder deposited on individual polymer particles is limited, therefore control of magnetic properties (which is a vital requirement of the carrier) is impossible.

SUMMARY OF THE INVENTION

The present invention provides a magnetic carrier for use in a developer composition which comprises individual core particles onto which there is provided an iron oxide magnetic plating layer. The carrier has a saturated magnetization ($\sigma$ e) of 20 to 80 emu/g. An object of the invention is to provide a lightweight carrier for the developer, wherein said carrier is prepared by forming a uniform magnetic plating layer on the surface of arbitrarily selected individual lightweight particles, wherein, unlike a conventional carrier, the light weight of the carrier does not necessitate a higher torque in a developing apparatus, and wherein otherwise less definite magnetic properties due to widely distributed particle sizes are controlled. Another object of the invention is to provide a carrier for a developer, wherein the lighter carrier reduces the amount of toner which adheres, during an extended period of operation, on the surface of individual carrier particles due to heat, wherein this feature in turn provides a high-quality image, and additionally, wherein the higher toner density due to a smaller average particle diameter eliminates the unstable quality of a resulting image due to an uneven density of toner deposited by a developing apparatus.

DETAILED DESCRIPTION OF THE INVENTION

More specifically, the invention provides a magnetic carrier for a developer, which comprises core particles which are individually provided with a magnetic iron oxide plating layer on the surface thereof, and have a saturated magnetization ($\sigma$ e ) of 20 to 80 emu/g.

According to the invention, the useful core particles are those arbitrarily selected and having a specific gravity of less than 4.0 when a plating of magnetic substance is provided thereupon. More specifically the available materials for such particles are as follows: resin particles including various elastic rubber substances; inorganic hollow particles such as glass balloon, silica balloon and shirasu balloon. Addditionally, according to the invention, a specific gravity means a measurement determined with a differential pressure aerometer (manufactured by Tokyo Science Co., Ltd.; Air Comparison Pycnometer, Model 930). A specific gravity of more than 4.0 greatly deteriorates the durability of the developer.

The methods to prepare resin particles are as follows: a method to pulverize synthesized resin and to classify the particles; and methods of granulation polymerization including emulsification polymerization, suspension polymerization, non-aqueous suspension polymerization, seed polymerization and the like. However, the granulation polymerization methods are advantageous for the reason that spherical particles, whose configurations are effective in improving the fluidity of the particles when employed in a developing apparatus, require fewer processing steps thereby ensuring a higher material balance and a smaller energy consumption.

In the case of the pulverization classification method, the particles are prepared by pulverizing any of the following resins and classifying the resultant particles. Examples of useful resins which may be singularly or combinedly used when as melted and blended are as follows: styrene resins such as polystyrene, poly-$\alpha$-styrene and the like; $\alpha$-methylene-aliphatic monocarboxylate resins such as methyl polymethacrylate, ethyl polymethacrylate and the like; phenol resins; rosin-modified phenolformalin resins; polyester resins; polyurethane resins; polyether resins, and others.

Usually in the case of the emulsification polymerization method, deionized water or deionized water where emulsifying agent have been dissolved is used, a portion of the polymeric monomer as a well as polymerization initiator are added, agitated and emulisifed, to which the rest of polymeric monomer is slowly added dropwise. Polymer particles having a diameter of 0.2 to 1$\mu$ are thus prepared. Using the particles as seeds, the desired particles used in the invention are thus prepared by subjecting polymeric monomers to seed polymerization.

Polymeric monomers useful for emulsification polymerization are those arbitrarily selected, whereby they may be used as far as they are polymerizable as well as being either singularly or combinedly used. Examples of such monomers are as follows: ethylene, propyrene, styrene, $\alpha$-chlorostyrene, $\alpha$-methylstyrene, 4-fluorostyrene, acrylic acid, methacrylic acid, acrylonitirile, methacrylonitrile, acrylamide, methyl acrylate, methylmethacrylate, ethyl acrylate, butyl acrylate, butyl methacrylate, ethylene glycol dimethacrylate; polyethylene glycol dimethacrylates such as diethylene glycol dimethacrylate, triethylene glycol dimethacrylate and the like; trifluoroethylmethacrylate, vinyl acetate, maleic anhydride, 2-vinyl pyridine, butadiene, isoprene and the like.

Other additives are as follows: free-radical type polymerization initiators such as hydrogen peroxide, peracetic acid, azo-bis-isobutylonitrile, t-butylhydroperoxide, ammonium persulfate, potassium persulfate and the like; redox type polymerization initiators such as sodium persulfate-sodium formaldehyde sulfoxylate, hydrogen peroxide-ascorbic acid and the like; emulsifying agents in the form of anionic surface active agents such as potassium stearate, potassium oleate, sodium dodecylsulfonate, sodium laurate and the like; emulsifying agents in the form of cationic surface active agents such as long-chained quaternary amine salt and the like; emulsifying agents in the form of nonionic surface active agents such as the ethylene oxide condensation product of lionlenic acid or lauric acid, and the like.

In the case of the suspension polymerization, method the desired particles are usually prepared by adding the polymeric monomers at a constant rate with agitation into deionized water where a water-soluble polymer or a slightly-water-soluble inorganic powder has been dissolved or dispersed in order to allow polymerization.

Polymeric monomers useful for suspension polymerization are those arbitrarily selected and may be used as far as they are polymerizable, and those used for emulsification polymerization mentioned previously may be either singularly or combinedly used.

Examples of useful dispersing agents are as follows: water-soluble high molecular substances such as gelatin, starch, polyvinyl alcohol, carboxymethyl cellulose and the like; slightly-water-soluble salts such as barium sulfate, calcium sulfate, barium carbonate, calcium carbonate, magnesium carbonate and the like; inorganic high molecular substances such as talc, silicic acid, silious earth and the like.

Examples of polymerization initiators are as follows: azo polymerization initiators including azobis-isobutylonitrile, azobis-4-methoxydimethylvaleronitrile, dimethylazobis-iobutylate and the like; peroxide polymerization initiators including t-butylperoxy-2-ethylhexanoate, di-t-butyl peroxide, benzoly peroxide, cumene peroxide and the like. Additionally, the previously mentioned aqueous initiators may be used in compliance with a specific requirement.

Regardless of the method used to prepare core particles, a preferred average particle diameter is within the range of 10 to 200$\mu$. With an average particle diameter of less than 10$\mu$, the carrier readily adheres to the surface of a photosensitive member. On the other hand, when the diameter exceeds 200$\mu$, the turf formed on the surface of the sleeve tends to be coarse, resulting in a deteriorated image resolution, as well as a greatly fluctuated image density due to the difficulty in controlling the toner content.

When resin particles are used as the core particles of the invention, those particles which are not mutually fused together in the course of forming a plating layer are advantageous.

The inorganic hollow particles are prepared by treating shirasu at a high temperature, or by separating them from fly ash derived from burning fine coal particles.

According to the invention, a plating film made of a magnetic substance of iron oxide is formed on the surface of the individual core particles. In other words, the individual core particles are encapsulated with a magnetic substance and therefore protected. The magnetic substance formed is usually of ferrite or magnetite.

One preferred method to form a magnetic plating layer is the electroless ferrite plating method proposed in Japanese Patent Laid-Open Publication No. 111929/1984 (corresponding to U.S. Pat. No. 4,477,319). In this patent publication, the ferrite wet plating method applicable to a plate-like material is proposed. However, when applied to particles, the ferrite layer is formed based on the activity of the surface of the individual particles Forming a ferrite film is performed in an aqueous solution containing core particles. Ferrous ions essential for forming the ferrite film are present in the aqueous solution. The ferrous ions are supplied to the aqueous solution in the form of ferrous salts such as ferrous chloride, sulfate or acetate. When the aqueous solution contains ferrous ions alone as metal ions, the resulting film is made of magnetite $Fe_3O_4$ which is a spinel ferrite containing iron alone as a metal element. Other transition metal ions ($M^{n+}$) other than ferrous ions may be contained in the aqueous solution. Other metal ion species include zinc ions, cobalt ions, nickel ions, manganese ions, copper ions, vanadium ions, antimony ions, lithium ions, molybdenum ions, titanium ions, rubidium ions, aluminum ions, silicon ions, chromium ions, tin ions, calcium ions, cadmium ions, indium ions and the like. When $M^{n+}$ represents cobalt, cobalt ferrite ($Co_xFe_{3-x}O_4$) is available, and when $M^{n+}$ comprises a plural species of ions, mixed crystal ferrite is available. The above metal ion species, other than ferrous ions, may be blended into the aqueous solution in the form of a water-soluble salt.

According to the invention, the formation of the ferrite film is initiated by adding an oxidizer solution to a deoxidized aqueous solution having ferrous ions and core particles. Examples of oxidizers used in the invention include nitrite, nitrate, hydrogen peroxide, organic peroxide, perchlorate, and water containing dissolved oxygen. The aqueous oxidizer solution should be favorably added dropwise continuously to the deoxidized aqueous solution, like a titration in analytical chemistry. The continuous addition of the solution facilitates regulation of the ferrite film thickness.

The pH value of the aqueous solution is arbitrarily selected and controlled depending upon the type of metal ion and is preferably 6 to 11, in particular, 7 to 11. To ensure a stable pH value, a buffer solution or a salt having a buffering effect, for example ammonium acetate, may be added.

The temperature requirement to perform the reaction of the invention is lower than the boiling point of the aqueous solution, and a temperature within a range of 60° to 90° C. is advantageous. The reaction is performed under a substantially deoxidized atmosphere. An atmosphere containing a large ratio of oxygen is disadvantageous because such an arrangement promotes an unnecessary oxidizing reaction. More specifically, the reaction should be performed under a nitrogenous atmosphere. For the same reason, the aqueous solution should be deoxidized to prepare the deoxidized aqueous solution.

If resin particles prepared by the previously mentioned granulation polymerization are used as the core particles to be used in the invention, the dispersion of the particles may be used without any treatment. However, when pulverized resin particles or particles of another material are used, such particles may be subjected to a pretreatment, which is performed for plate-like materials including a magnetic disk, such as the plasma treatment, alkaline treatment, acid treatment or other physical treatments. Performing these treatments improves the wettability of the particles to an aqueous solution, thus providing a uniform film.

The advantageous method according to the invention are as follows. First, core particles are suspended in deoxidized water. At the same time, additives such as a surface active agent or an alcohol may be added, in accordance with a specific requirement, in order to improve wettability of the particles to water. Next, a pH buffer may be mixed into the solution, if necessary, to maintain a desired pH range, thereby salt having ferrous ions is added. Other metal ions may be added together with the ferrous ions, in accordance with a requirement. Once all the materials have been blended into the solution, the reaction is allowed to proceed by adding an oxidizing solution dropwise to the aqueous solution as described previously. This step is advantageous in that the thickness of ferrite film is adjusted based on the concentration of metal ion species or oxidizer contained in the solution. The ferrite plated particles are obtained by filtering and drying the dispersion after the plating step.

With this method, since ferrous hydroxide ions and/or another species of metal ions are adsorbed by the formed crystal layer, the thickness of the crystal layer may be regulated by controlling the concentration of metal ions in the bath. Accordingly, a carrier having an arbitrarily determined magnetization is obtained by controlling the metal ion concentration in the bath. Additionally, the electrical conductivity and the like of the formed magnetic crystal layer is arbitrarily determined by regulating the concentration of ferrous hydroxide ions and another species of metal ions in the bath.

The formed magnetic plating layer is deliberately designed so that the carrier has a saturated magnetization ($\sigma$ e) of 20 to 80 emu/g or, preferably, 30 to 65 emu/g. With a saturated magnetization of less than 20 emu/g, the carrier will leave the surface of the magnetic sleeve and adhere to the surface of the photosensitive drum. On the other hand, with a saturated magnetization of more than 80 emu/g, the magnetic brush formed on the sleeve tends to be rigid, giving rise to various disadvantages including the deteriorated reproduction of half-tones, and generation of brush marks. For this reason, the designed thickness of magnetic plating is within the above mentioned range of saturated magnetization.

To adjust the electrical resistivity and triboelectrical charging properties of the carrier of the invention, as well as to further improve the service life of the carrier by preventing the surface of the individual carrier particles from being contaminated with toner particles, which is a phenomenon known as "spent toner", the surface of the magnetic plating layer may be coated with a resin. Since not readily adhering to toner particles, the resins preferable for this purpose include ethylene tetrafluoride resin, polyvinylidene fluoride resin, silicon resin and the like. The coating methods of such a resin are conventionally known methods such as the fluidized bed method, spray drying method and the like.

(EFFECT OF THE INVENTION)

The carrier obtained according to the invention is light in weight. If a smaller particle diameter is selected for the carrier, the toner density is accordingly made larger, thus stably providing high quality images for a longer period. Correspondingly, the copying apparatus can be smaller and more energy-efficient. By forming a ferrite layer with the wet plating method, a carrier having a uniform and sufficient saturated magnetization is provided, without a high-temperature treatment or other process.

(EXAMPLES)

The present invention is hereinunder described with reference to the examples embodying the invention. However, the scope of the invention is not necessarily limited only to these examples. In the following examples, "parts" and "%" are based on weight.

EXAMPLE 1

(Synthesizing nuclide resin particle)

First, 150 parts of deionized water was poured into a polymerization-reaction container which was equipped with an agitator, a thermometer, a monomer-dripping funnel, a reflux condenser, a heating device, and a nitrogen-introduction pipe. Next, at a temperature of 80 degrees, a part of the mixed monomer (A) whose composition ratio was 90:10 of styrene and 2-ethylhexyl acrylate; and 10 parts of 10% ammonium persulfate water solution were poured. Then, 99 parts of above-described mixed monomer (A) was added by dripping as long as three hours, thereby obtaining a seed latex. The particles thus obtained were observed using an electron microscope to measure the diameters of the particles. The diameters showed mono-dispersion of 0.6 micron.

Using the same system, 0.2 parts of seed latex were first added to 250 parts of deionized water, than at a temperature of 80 degrees, 10 parts of 10 % ammonium persulfate water solution and 100 parts of mixed monomer (A) were added by means of dripping for as long as 8 hours; thus latex particles having diameters ranging from 6 to 8 microns were obtained through this seed polymerization.

Next, using the same system, 10 parts of the seed latex was added to 250 parts of deionized water, and at a temperature of 80 degrees, 10 parts of 10% ammonium persulfate water solution was added, and then 110 parts of mixed monomer (B) composed of styrene and tetraethylene-glycol dimethacrylate at a ratio of 85:15 was added by means of dripping for as long as 8 hours; thus resin particle emulsion was obtained. The average particle diameter of the resin particles, obtained by means of using a wet particle size distribution scale (Colter counter TA-II Type; Colter Co., Ltd.), was 25 microns.

(Forming magnetic plated layer)

Prior to executing the plated-layer forming operation, 50% (weight ratio) of deionized water solution comprised of ferrous chloride, manganese chloride, nickel chloride, zinc chloride, ammonium acetate, and also a 10% (weight ratio) of deionized water solution comprised of sodium nitrite were prepared. The above-mentioned three kinds of water solutions were also used in other examples and comparison examples.

A quantity of 100 parts (solid portion 30%) of the above-mentioned emulsion as well as $N_2$ gas were introduced into a magnetic-material generating system which was equipped with an agitator, a thermometer, oxidation agent solution, monomer-dripping funnel, a heating device, and a nitrogen-introduction pipe, whereby the oxygen in the emulsion was deaerated.

Next, 240 prepared parts of ferrous chloride solution (120 parts of solid portion), and 400 parts of ammonium acetate (200 parts of solid portion) were introduced into the system, which were then heated to 70 degrees while those materials were sufficiently agitated and mixed therein. After this, the mixture was modified to a level of pH 7.2 by means of aqueous ammonia while continuing the agitation.

The above-described solution was supplied with 270 parts of (27 parts of solid portion) sodium-nitrite solution by means of dripping for as long as one hour. While executing the dripping process and while the reaction was taking place, nitrogen gas was introduced and agitated in the solution so as to maintain the liquid temperature at 7 C. degrees as well as the pH level from 7.0 to 7.2, thus forming the magnetite over the surface of the particles thereon. Approximately 20 minutes later, the solution was cooled and after repeating the filtration and cleaning using the deionized water, the particles were taken out and dried, thus the magnetic plated particles (I) were obtained. The magnetic plated particles (I) thus obtained underwent an X-ray analysis and were observed by means of an electrcon microscope, whereby it was recognized that a unfiorm magnetite crystalline layer was formed on the surface thereon. The plated particles thus obtained had a sepecific gravity of 2.15, electrical resistance of $2\times10^6$ ohm cm, and saturation magnetization of 50 emu/g.

(Resin coating)

A quantity of 5 parts of silicon resin liquid (KR 9706; The Shin-Etsu Chemical Co., Ltd) in the form of a solid, and 200 parts of methyl ethyl-ketone were poured and mixed in the 500 cc round-bottomed flask, and 100 parts of the above-described magnetic plated particles (I) was introduced, agitated, and mixed for as long as 10 minutes; then, the solvent-removing processing was executed by means of an evaporator. After drying, the particles were classified using a filter having a 281 mesh, the particles were then further classified using an air classifier so as to eliminate particles of less than 10 microns in diameter, thus a carrier (I) was obtained. The resistance of the carrier (I) was $5\times10^8$ ohm cm.

Table 1 shows the composition, condition, and characteristics of each example as well as a comparison example.

EXAMPLE 2

(Manufacturing nuclide particle dispersion solution)

A quantity of 100 portions of the commercial silica micro balloon (Filite 52/7 (FG)): Japan Filite Co., Ltd.) was first dispersed in 0.1 mol water solution (500 parts) of hydrochloric acid; then, the broken silica balloons were removed and the floated particles were taken out in order to be cleaned with the deionized water so as to eliminate the excessive alkali metal salt. The silica micro balloon thus obtained was then classified using a filter of 100 mesh and 200 mesh, whereby the nuclide particles having an average diameter of 110 microns were obtained. A quantity of 15 parts of the above-described nuclide particles were then dispersed in the 70 parts of deionized water whereby nuclide particle dispersion liquid having a concentration of 15% by weight of the solid portion was obtained.

(Forming magnetic plated layer)

The carrier (II) was obtained by means of the same procedures and system as that of example 1, except in the following conditions wherein 100 parts of the above-mentioned dispersed liquid, 160 parts of ferrous chloride solution, 80 parts of nickel chloride solution, 300 parts of ammonium acetate solution, and 220 parts of sodium-nitrite solution were used, and the pH level and temperature were set to 7.0 and 65 degress respectively. A part of the particles thus obtained, was introduced into 10 cc of 5 mol hydrochloric acid solution, and the composition of the layer was analyzed by means of X-ray analysis as well as by the atomic absorption method, whereby the composition was determined to be $Ni_{0.4}Fe_{2.6}O_4$.

EXAMPLE 3

The particles were synthesized by means of the suspension polymerization method, and then cleaned and classified using the 200 -mesh and 400-mesh filters. The spherical phenol-resin (PF resin S type; Unitica Co., Ltd.) particles thus obtained were scattered in the deionized water so that the weight ratio of the solid portion became 30%. Then, the magnetic plated particles (III) and carrier (III) were obtained through the same operations as those employed in example 1 under the conditions and composition shown in Table 1.

EXAMPLE 4

(Manufacturing nuclide particles)

The styrene-methacrylic acid n-butyl copolymer (composition ratio 85:15) was pulverized using the pin mill; then, the pulverized powder was sprayed in the hot air so as to execute the spheroidizing processing. The powder was then classified using the 50-mesh and 75-mesh filters whereby nuclide particles having an average diameter of 200 microns were obtained.

A quantity of 100 parts of the above-mentioned particles were uniformly dispersed by means of a disperser (TK Homomixer M Type; Special Chemical Co., Ltd.) in 223 parts of the deionized water which was diluted with one part of the nonionic surface active agent (Nonipole 100; Sanyo Chemical Co., Ltd.), and then, the particles were deaerated using a vacuum deaerator.

(Forming magnetic plated layers)

Using the same system as used in example 1, the carrier (IV) was obtained by forming the magnetic plated layer under the conditions and composition shown in Table 1.

Table 1 shows the characteristics of each particle.

EXAMPLE 5

(Snythesizing nuclide resin particles)

First, 150 parts of deionized water was poured into a polymerization-reaction container which was equipped with an agitator, a thermometer, a monomer-dripping funnel, a reflux condenser, a heating device, and a nitrogen-introduction pipe. Next, at a temperature of 80 degrees, a part of the mixed monomer (A) whose composition ratio was 90:10 of styrene and 2-ethylhexyl acrylate, and 10 parts of 10% ammonium persulfate water solution were poured. Then, 99 parts of the above-described mixed monomer (A) was added by dripping for as long as three hours whereby a seed latex was obtained. The particles thus obtained were observed using an electron microscope to measure the diameters of the particles; the diameters showed monodipsersion of 0.6 micron.

Using the same system, 0.2 parts of seed latex were first added to 250 parts of deionized water, than at a temperature of 80 degrees, 10 parts of 10% ammonium persulfate water solution and 100 parts of mixed monomer (A) were added by means of dripping for as long as 8 hours; latex particles having diameters ranging from 6 to 8 microns were thus obtained through this seed polymerization Next, using the same system, 30 parts of the seed latex was added to 213 parts of deionized water, and at a temperature of 80 degrees, 10 parts of 10% ammonium persulfate water solution was added, and then 93 parts of the mixed monomer (B) was drippped to the solution for as long as eight hours; resin particle emulsion was thus obtained. The average particle diameter of the resin particles, obtained by means of using a wet particle size distribution scale (Colter counter TA-II Type; Colter Co., Ltd.), was 12 microns.

(Forming magnetic plated layer)

The magnetic plated carrier (V) and carrier (V) were obtained through a process such as magnetic plated layer formation or resin coating by using the same system employed in example 1 and under the conditions and compositions shown in Table 1.

EXAMPLE 6

(Synthesizing nuclide particles)

The resin particles obtained in example 1 were used.

(Forming magnetic plated layer and resin coating)

The magnetic plated carrier (VI) and carrier (VI) were obtained through a process such as magnetic plated layer formation or resin coating by using the same system employed in example 1 and under the conditions and compositions shown in Table 1.

EXAMPLE 7

(Synthesizing nuclide particles)

The resin particles obtained in example 1 were used.

(Forming magnetic plated layer)

The magnetic plated carrier (VII) and carried (VII) were obtained through a process such as magnetic plated layer formation or resin coating by using the same system employed in example 1 and under the conditions and compositions shown in Table 1.

EXAMPLE 8

(Snythesizing nuclide resin particles)

A medium in which three parts of polyvinyl alcohol (Gosenole KH-17; Japan Synthesizing Chemical Cp., Ltd.) were dissolved in 600 parts of deionized water was introduced into the same reaction system employed in example 1; then, the liquid temperature was raised to 70 degrees, and the solution was agitated at a speed of 200 rpm. At the same time, a mixture of 170 parts of styrene, 30 parts of acrylic acid n-butyl, 57 parts of ethylene glycol dimetha-acrylate, and 2.5 parts of azo-bis-dimethyl-valeronitrile was dripped at a constant speed for as long as 1.5 hours. This mixture was agitated and maintained at the same temperature for as long as five hours. After cooling, the mixture was filtered using 180-mesh and 120-mesh filters; then, 190 parts of the particles were redispersed in 450 parts of deionized water, and thus a dispersion liquid having a 30% solid portion was obtained. The particles thus obtained have an average diameter of 100 microns.

(Forming magnetic plated layer and resin coating)

The magnetic plated particles (VIII) and carrier (VIII) were obtained through a process such as magnetic plated layer formation or resin coating by using the same system employed in example 1 and under the conditions and compositions shown in Table 1.

EXAMPLE 9

(Manufacturing nuclide particle dispersion liquid)

After classifying the commercial spherical bridged polystyrene resin particles (Fine Pearl) PB-3002; Sumitomo Chemical Co., Ltd.) into the particles having the average diameter of 30 microns, 100 parts of the particles were dispersed in 233 parts of deionized water in which 6 parts of nonionic surface active agent (Nonipole 100; Sanyo Chemical Co., Ltd.) were dissolved using a disperser (TK Homomixer M Type; Special Chemical Co., Ltd.); then, the particles were deaerated with a vacuum deaerator.

(Forming magnetic plated layer and resin coating)

The magnetic plated particles (VIII) and carrier (VIII) were obtained through a process such as magnetic plated layer formation or resin coating by using the same system employed in example 1 and under the conditions and composition shown in Table 1.

COMPARISON EXAMPLE 1

(Synthesizing resin particles)

First, 150 parts of deionized water were poured into a polymerization-reaction container which was equipped with an agitator, a thermometer, a monomer-dripping funnel, a reflux condenser, a heating device, and a nitrogen-introduction pipe. Next, at a temperature of 80 degrees, a part of the mixed monomer (A), whose composition ratio was 90:10 of styrene and 2-ethylhexyl acrylate, and 10 parts of 10% ammonium persulfate water solution were poured. Then, 99 parts of the above-described mixed monomer (A) were added by dripping for as long as three hours, thereby obtaining a seed latex. The particles thus obtained were observed using an electron microscope to measure the diameters of the particles; the diameters showed mono-dispersion, 0.6 microns.

Using the same system 0.2 parts of seed latex were first added to 250 parts of deionized water; then at a temperature of 80 degrees, 10 parts of 10 % ammonium persulfate water solution and 100 parts of mixed monomer (B) used in example 1 were added by means of dripping for as long as 8 hours; thus, latex resin particles having diameters ranging from 6 to 8 microns were obtained through this seen polymerization. The average diameter of the resin particles was 7.5 microns.

(Forming magnetic plated layer and resin coating)

The magnetic plated particles (X) and carrier (X) were obtained through a process such as magnetic plated layer formation or resin coating by using the same system employed in example 1 and under the conditions and compositions shown in Table 1.

The developers were made by mixing the toner having an average diameter of 11 microns, manufactured by the ordinary dry-type-toner manufacturing method, the carriers (I)-(X) obtained in example 1 through 9 and composition example 1, and the commercial ferrite carrier (XI) having an average particle diameter of 50 microns. The copying performance of these developers was determined using the remodeled type of the ordinary-paper type copying machine (U-Bix 3000 Konishiroku Photo Industry Co., Ltd). Table 1 shows the test results.

| Toner composition | Weight ratio |
|---|---|
| Styrene resin (Trade name "Piccolastic D-150" Hercules Co., Ltd.) | 85 |
| Carbon black (Trade name "Monarch 880" Cabot Corp.) | 8 |
| Polypropylene wax (Trade name "Biscole 550P" Sanyo Chemical Industry Co., Ltd.) | 7 |
| Oil black (Trade name "Bontron S-34 Orient Chemical Co., Ltd.) | 2 |

TABLE 1

| | | Examples | | | | | | | | | Comparison Examples | |
|---|---|---|---|---|---|---|---|---|---|---|---|---|
| | | 1 | 2 | 3 | 4 | 5 | 6 | 7 | 8 | 9 | 1 | 2 |
| Weight ratio | Nuclide particle | 100 | 100 | 100 | 100 | 100 | 100 | 100 | 100 | 100 | 100 | |
| | $FeCl_2$ | 240 | 160 | 106 | 150 | 240 | 300 | 60 | 320 | 240 | 250 | |
| | $MnCl_2$ | — | — | — | 60 | — | — | 36 | — | — | — | |
| | $NiCl_2$ | — | 80 | — | — | — | — | — | 120 | — | — | |
| | $ZnCl_2$ | — | — | — | — | — | 60 | — | — | — | — | |
| Bath Condition | Sodium acetate | 400 | 300 | 100 | 300 | 400 | 300 | 100 | 300 | 400 | 400 | |
| | Nitrous acid | 270 | 220 | 120 | 180 | 270 | 330 | 70 | 400 | 270 | 270 | |
| | pH | 7.2 | 7.0 | 7.2 | 7.3 | 7.2 | 7.0 | 7.0 | 7.0 | 7.2 | 7.2 | |
| | Temperature | 70 | 65 | 70 | 65 | 70 | 65 | 65 | 65 | 70 | 70 | |
| Surface Treatment | Plated particle | 100 | — | 100 | — | 100 | 100 | 100 | 100 | 100 | 100 | |
| | Silicone resin(1) | 5 | — | 10 | — | 10 | 12 | 5 | 5 | 5 | 10 | |
| | Methyl ethyl ketone | 200 | — | — | — | 300 | 200 | 200 | 200 | 200 | 300 | |
| | Ethyl acetate | — | — | 200 | — | — | — | — | — | — | — | |
| Nuclide particle diameter μ | | 25 | 110 | 50 | 200 | 12 | 25 | 25 | 100 | 30 | 7.5 | — |
| Plated particle characteristics | Specific gravity | 2.15 | 1.3 | 1.7 | 1.9 | 21.5 | 2.9 | 1.6 | 2.5 | 2.15 | 2.15 | — |
| | Saturation magnetization(2) (emu/g) | 50 | 60 | 30 | 40 | 50 | 70 | 25 | 60 | 50 | 50 | — |
| | Composition | $Fe_3O_4$ | $Ni_{0.4}$—$Fe_{2.6}O_4$ | $Fe_3O_4$ | $Mn_{0.2}$—$Fe_{2.8}O_4$ | $Fe_3O_4$ | $Zn_{0.2}$—$Fe_{2.8}O_4$ | $Mn_{0.3}$—$Fe_{2.7}O_4$ | $Ni_{0.2}$—$Fe_{2.8}O_4$ | $Fe_3O_4$ | $Fe_3O_4$ | Cu—Zn ferrite |
| Developer characteristics | Torque(3) (kg · cm) | 3.4 | 3.0 | 2.9 | 3.1 | 3.5 | 4.2 | 2.7 | 3.7 | 3.3 | 3.0 | 6.5 |
| | Fly carrier(4) | None | None | None | None | None | None | None | None | None | Exist | None |
| | Brush mark in | None | None | None | None | None | None | None | None | None | None | Exist |

TABLE 1-continued

| | Examples | | | | | | | | | Comparison Examples | |
|---|---|---|---|---|---|---|---|---|---|---|---|
| | 1 | 2 | 3 | 4 | 5 | 6 | 7 | 8 | 9 | 1 | 2 |
| the solid portion | | | | | | | | | | | |

(1)KR 9706 Shinetsu Chemical Co., Ltd.
(2)Vibration-sample type magnetometer (VSM-3 Type Toshiba Co., Ltd.).
(3)Measured from the current value of the motor for driving the developing machine.
(4)Determined by observation.

What is claimed is:

1. A magnetic carrier for use in a developer composition having a saturation magnetization ranging from 20 to 80 emu/g, wherein a magnetic plated layer composed of an iron oxide is formed on each surface of a nuclide particle selected from the group consisting of a resin particle and an inorganic hollow particle.

2. A magnetic carrier as claimed in claim 1, wherein the specific gravity of each plated particle is less than 4.0.

3. A magnetic carrier as claimed in claim 1, wherein the magnetic plated layer is composed of ferrite.

4. A magnetic carrier as claimed in claim 1, wherein the magnetic plated layer is formed by means of an electroless ferrite plating method.

5. A magnetic carrier as claimed in claim 1, wherein the nuclide particle is a resin particle.

6. A magnetic carrier as claimed in claim 1, wherein the average diameter of magnetic plated particles ranges from 10 to 60 microns.

7. A magnetic carrier as claimed in claim 1, wherein the magnetic plated layer on the nuclide particle surface is coated with resin.

8. A magnetic carrier as claimed in claim 2, wherein the magnetic plated layer on the nuclide particle surface is coated with resin.

9. A magnetic carrier as claimed in claim 3, wherein the magnetic plated layer on the nuclide particle surface is coated with resin.

10. A magnetic carrier as claimed in claim 4, wherein the magnetic plated layer on the nuclide particle surface is coated with resin.

11. A magnetic carrier as claimed in claim 5, wherein the magnetic plated layer on the nuclide particle surface is coated with resin.

12. A magnetic carrier as claimed in claim 6, wherein the magnetic plated layer on the nuclide particle surface is coated with resin.

* * * * *